US009352460B2

(12) United States Patent
Steinke et al.

(10) Patent No.: US 9,352,460 B2
(45) Date of Patent: May 31, 2016

(54) HOLDING DEVICE FOR HAND MACHINE TOOLS, IN PARTICULAR HOLDING DEVICE FOR A DRILL AND/OR CHIPPING HAMMER

(75) Inventors: Hubert Steinke, Leinfelden-Echterdingen (DE); Lars Schmid, Nuertingen (DE); Johannes Schnitzler, Reutlingen (DE); Gerhard Meixner, Filderstadt (DE); Christian Koepf, Wherstead (GB); Jan Koalick, Leinfelden (DE)

(73) Assignee: Robert Bosch GmbH, Stuttgart (DE)

( * ) Notice: Subject to any disclaimer, the term of this patent is extended or adjusted under 35 U.S.C. 154(b) by 1041 days.

(21) Appl. No.: 13/381,542

(22) PCT Filed: Apr. 30, 2010

(86) PCT No.: PCT/EP2010/055880

§ 371 (c)(1), (2), (4) Date: Apr. 11, 2012

(87) PCT Pub. No.: WO2011/000595

PCT Pub. Date: Jan. 6, 2011

(65) Prior Publication Data

US 2012/0187639 A1 Jul. 26, 2012

(30) Foreign Application Priority Data

Jun. 30, 2009 (DE) ..... 10 2009 027 316

(51) Int. Cl.
*B25D 17/08* (2006.01)
*B25D 17/06* (2006.01)

(52) U.S. Cl.
CPC ..... *B25D 17/06* (2013.01); *B25D 17/08* (2013.01); *B25D 2217/0019* (2013.01); *B25D 2250/065* (2013.01); *B25D 2250/351* (2013.01); *Y10T 279/17042* (2015.01)

(58) Field of Classification Search
CPC .. B25D 17/06; B25D 17/08; B25D 2250/065; B25D 2250/351; B25D 2217/0019; Y10T 279/17042
USPC ..... 279/19–19.7, 28, 29, 76, 75; 173/132, 173/210, 211
See application file for complete search history.

(56) References Cited

U.S. PATENT DOCUMENTS 2,080,887 A * 5/1937 Fuehrer ..... 279/19.1
4,222,462 A * 9/1980 Ottestad ..... 188/67

(Continued)

FOREIGN PATENT DOCUMENTS

CH 556 719 A 12/1974
DE 44 19 826 A1 12/1995

(Continued)

OTHER PUBLICATIONS

International Search Report corresponding to PCT Application No. PCT/EP2010/055880, mailed Aug. 24, 2010 (German and English language document) (6 pages).

*Primary Examiner* — Eric A Gates
*Assistant Examiner* — Paul M Janeski
(74) *Attorney, Agent, or Firm* — Maginot, Moore & Beck LLP

(57) ABSTRACT

A holding device for hand machine tools, in particular a drill and/or a chipping hammer holding device, includes a hammer tube and at least one blocking body, which, when installed, connects the hammer tube to at least one additional holding component. The blocking body is provided with at least one blocking surface that is curved around at least one load tipping axis.

14 Claims, 4 Drawing Sheets

(56) References Cited

U.S. PATENT DOCUMENTS

| | | | | | |
|---|---|---|---|---|---|
| 4,878,679 | A | * | 11/1989 | Plank et al. | 279/19.4 |
| 4,903,784 | A | * | 2/1990 | Glaser | 173/200 |
| 5,470,084 | A | * | 11/1995 | Reibetanz et al. | 279/19.3 |
| 5,954,347 | A | * | 9/1999 | Buck et al. | 279/20 |
| 2005/0146097 | A1 | * | 7/2005 | Hellbach et al. | 279/19.1 |

FOREIGN PATENT DOCUMENTS

| | | | |
|---|---|---|---|
| DE | 198 10 088 | C1 | 8/1999 |
| EP | 0 684 109 | A1 | 11/1995 |
| WO | 03037571 | A1 | 5/2003 |

* cited by examiner

HOLDING DEVICE FOR HAND MACHINE TOOLS, IN PARTICULAR HOLDING DEVICE FOR A DRILL AND/OR CHIPPING HAMMER

This application is a 35 U.S.C. §371 National Stage Application of PCT/EP2010/055880, filed Apr. 30, 2010, which claims the benefit of priority to Ser. No. DE 10 2009 027 316.6, filed Jun. 30, 2009 in Germany, the disclosures of which are incorporated herein by reference in their entirety.

BACKGROUND

The disclosure is based on a holding device for a portable power tool.

Rotary- and chisel-hammer holding devices are known which have a hammer tube and locking bodies which connect the hammer tube to a tool chuck in the fitted state.

SUMMARY

The disclosure is based on a holding device for a portable power tool, in particular a rotary- and/or chisel-hammer holding device, having a hammer tube and at least one locking body which connects the hammer tube to at least one further holding component in a fitted state.

It is proposed that the locking body have at least one locking surface curved about at least one load tilting axis. In this case, the expression "hammer tube" is intended to mean in particular an elongated, hollow component, in particular a hollow shaft, in which a striker of a percussion mechanism, a piston, in particular a skirt-type piston, and/or a percussion pin interacting with a striker is guided in the longitudinal extent of the hammer tube. The expression "load tilting axis" is intended to mean in particular an axis about which the locking body is tilted during a main load, such as, in particular, during a load on the hammer tube and/or on the holding component, to be connected to the hammer tube, in the axial direction of the hammer tube and/or in the circumferential direction of the hammer tube. Large load-bearing areas, small surface pressures, low wear and a long service life can be advantageously achieved by an appropriate configuration.

In this case, the locking surface can have various curvatures which seem appropriate to the person skilled in the art and can also be produced by various methods which seem appropriate to the person skilled in the art, e.g. by means of material removal processes, e.g. milling processes. In an especially advantageous manner, however, the locking surface is formed at least partly by a cambered surface, i.e. a surface produced by a plastic deformation operation, such as, in particular, by a rolling operation, as a result of which the service life can be further increased. The locking surface of the locking body can be designed in principle to be at least partly concave and/or, in an especially advantageous manner, to be at least partly and preferably completely convex.

Various components of the holding device for the portable power tool which seem appropriate to the person skilled in the art can be connected to the hammer tube by means of one or more corresponding locking bodies. However, if the holding device for the portable power tool has a tool holder having at least one holding surface which corresponds with the locking body in at least one operating state, an especially space-saving design, in particular without an additional holding flange, can be achieved. In this connection, the expression "tool holder" is intended to mean in particular a component which has an accommodating region for an application tool, such as in particular for a drill and/or chisel.

In a further configuration of the disclosure, it is proposed that the hammer tube and, in an especially advantageous manner, at least one further holding component have at least one curved holding surface which corresponds with the curved locking surface in at least one operating state, as a result of which surface pressure which occurs and wear which occurs can be further reduced.

The locking body can in principle have various shapes which seem appropriate to the person skilled in the art; for example, said locking body can be designed to be spherical, parallelepiped-shaped, bean-shaped, etc., and preferably correspondingly adapted mating surfaces should then be provided. In an especially advantageous manner, however, the locking body has, in the fitted state, a greater extent at least in the radial direction of the hammer tube than in the axial direction of the hammer tube, as a result of which advantageous overlapping can be achieved.

It is also proposed that the locking body have at least one curved end face and/or a curved lateral surface. In this case, the expression "end face" is intended to mean in particular a surface pointing in the longitudinal direction of the locking body, preferably in the radial direction of the hammer tube, and a "lateral surface" is intended to mean in particular a surface pointing transversely to a longitudinal direction and extending about a longitudinal axis of the locking body. Advantageous force flows and small surface pressures can be advantageously achieved by an appropriate configuration, specifically, in particular, if the locking body has at least two locking surfaces.

BRIEF DESCRIPTION OF DRAWINGS

Further advantages follow from the description of the drawings below. Exemplary embodiments of the disclosure are shown in the drawings. The drawings, the description and the claims contain numerous features in combination. The person skilled in the art will also expediently consider the features individually and combine them to form appropriate further combinations.

In the drawing.

DETAILED DESCRIPTION

Figure 1:
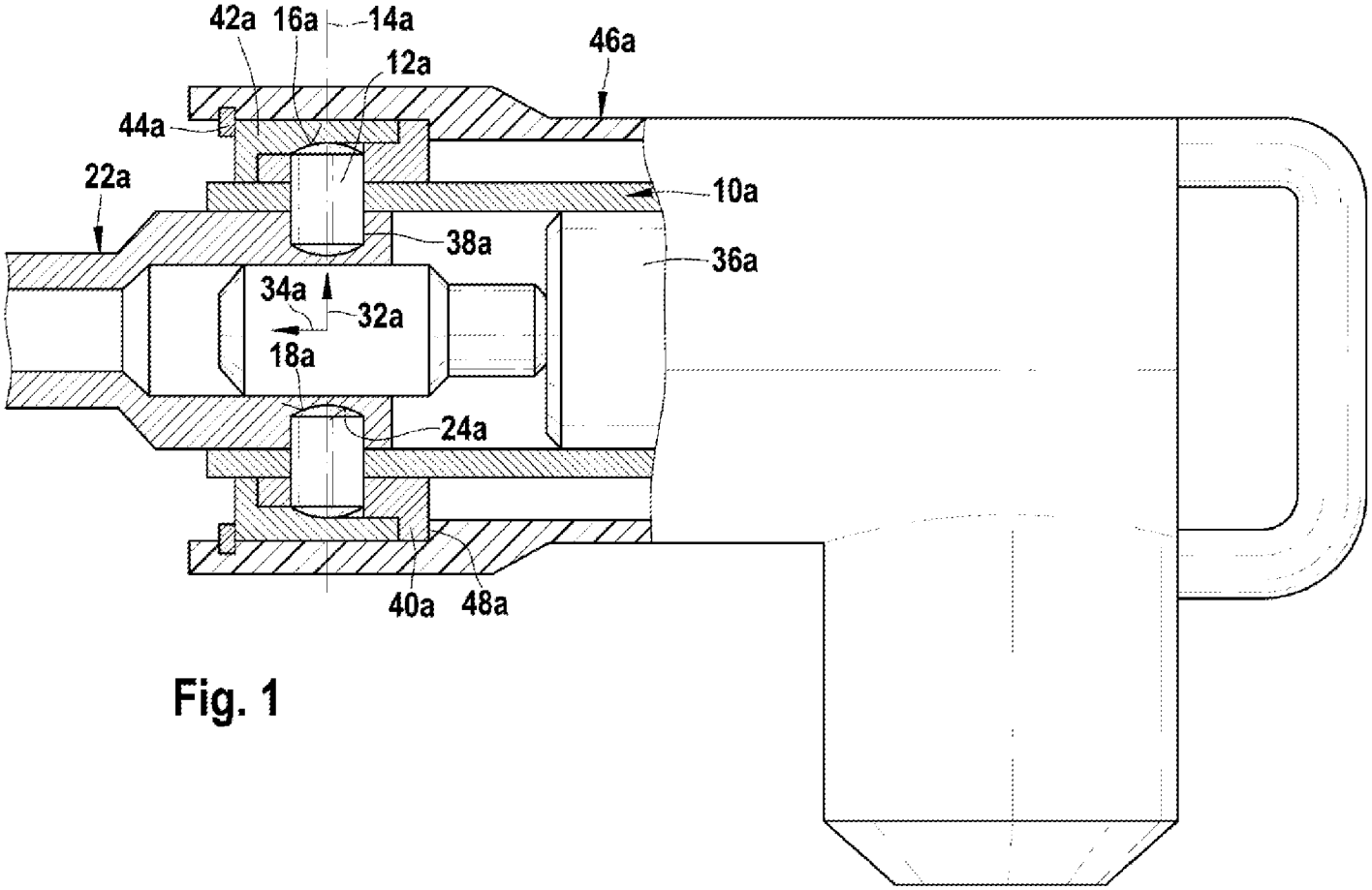
FIG. 1 shows a schematic illustration of a rotary and chisel hammer with a partial section through a rotary- and chisel-hammer holding device.

FIG. 1 shows a schematically illustrated rotary and chisel hammer with a partial section through a rotary- and chisel-hammer holding device of the rotary and chisel hammer. The rotary- and chisel-hammer holding device comprises a hammer tube 10*a* in which a striker 36*a* of a percussion mechanism (not shown in any more detail) is guided. Furthermore, the rotary- and chisel-hammer holding device has three locking bodies 12*a* of the same kind which are uniformly distributed over the circumference of the hammer tube 10*a* and which, in a fitted state, connect the hammer tube 10*a* to a holding component for conjoint rotation and in an axially fixed manner, said holding component being formed by a tool holder 22*a*. The tool holder 22*a* has an outside diameter which is smaller than an inside diameter of the hammer tube 10*a* and is inserted into the hammer tube 10*a*.

The locking body 12*a* passes radially through a round aperture in the hammer tube 10*a*, said aperture being defined by a holding surface 28*a*. The locking body 12*a* has two locking surfaces 16*a*, 18*a* (FIG. 2) which are convexly curved about its load tilting axis 14*a* and are formed by cambered surfaces. The locking body 12*a* is of cylinder-like design and has, in the fitted state, a greater extent in the radial direction 32*a* of the hammer tube 10*a* than in the axial direction 34*a* of the hammer tube 10*a*. The locking surfaces 16*a*, 18*a* are formed by opposite end faces of the locking body 12*a*.

In accordance with the number of locking bodies 12*a*, the tool holder 22*a* has blind-hole recesses 38*a* on its inner circumference, specifically blind holes, the center axes of which extend radially relative to the hammer tube 10*a*. The blind-hole recess 38*a* is defined in the radial direction by a holding surface 24*a* of the tool holder 22*a*, said holding surface 24*a* corresponding with the locking body 12*a* in an operating state and being concavely curved about the load tilting axis 14*a*. Furthermore, the rotary- and chisel-hammer holding device has, in the radially outer region of the hammer tube 10*a*, a perforated ring 40*a*, through which the locking body 12*a* passes in the radial direction. In the radially outer region of the perforated ring 40*a*, the rotary- and chisel-hammer holding device has a holding component which is formed by a holding ring 42*a* and which has a concavely curved holding surface 30*a* on its side pointing radially inward, said holding surface 30*a* corresponding with the locking surface 16*a* of the locking body 12*a* in an operating state. The perforated ring 40*a* has a stepped outer contour and the holding ring 42*a* has a stepped inner contour. The inner contour and the outer contour are matched to one another, and the inner contour and the outer contour engage one inside the other in a positive-locking manner in the axial and radial directions. The perforated ring 40*a* and the holding ring 42*a* are secured in the axial direction 34*a* of the hammer tube 10*a* inside a portable power tool housing 46*a* by means of a clamping ring 44*a* and by means of a step 48*a* integrally formed on the portable power tool housing 46*a*.

Figure 2:
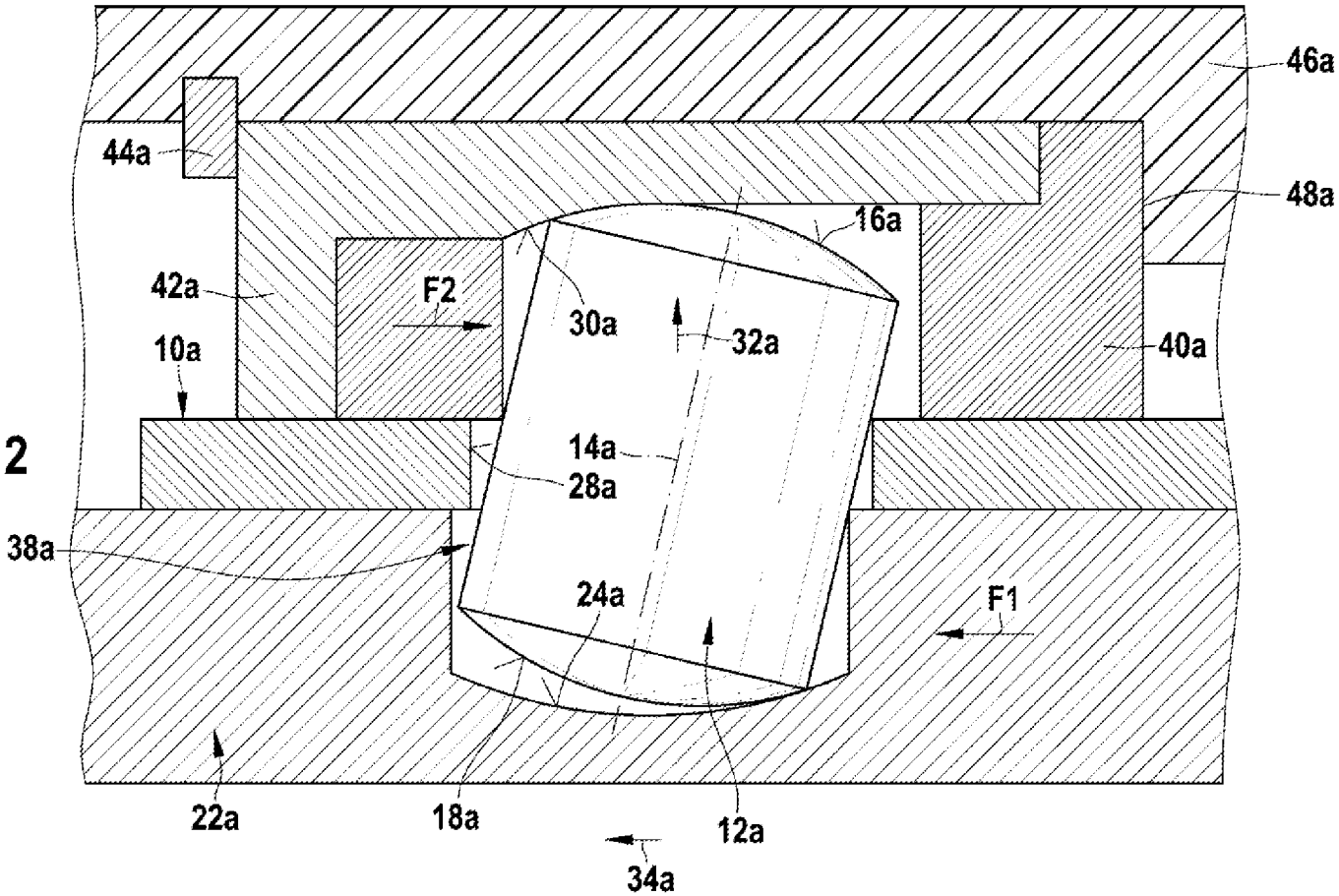
FIG. 2 shows an enlarged illustration of a detail from FIG. 1, with play and tilt angle shown greatly exaggerated.

If, for example, a force F1 loading the tool holder 22*a* in an axial direction away from the striker 36*a* occurs during operation, the locking body 12*a* is tilted about the load tilting axis 14*a* running perpendicularly to the axial direction 34*a* of the hammer tube 10*a* by the force F1 and a reaction force F2 opposed to the force F1, as shown exaggerated in FIG. 2 for illustration. As a result of the curved locking surfaces 16*a*, 18*a* and the curved holding surfaces 24*a*, 30*a*, large contact areas, small surface pressures and low wear are advantageously achieved.

Figure 3:
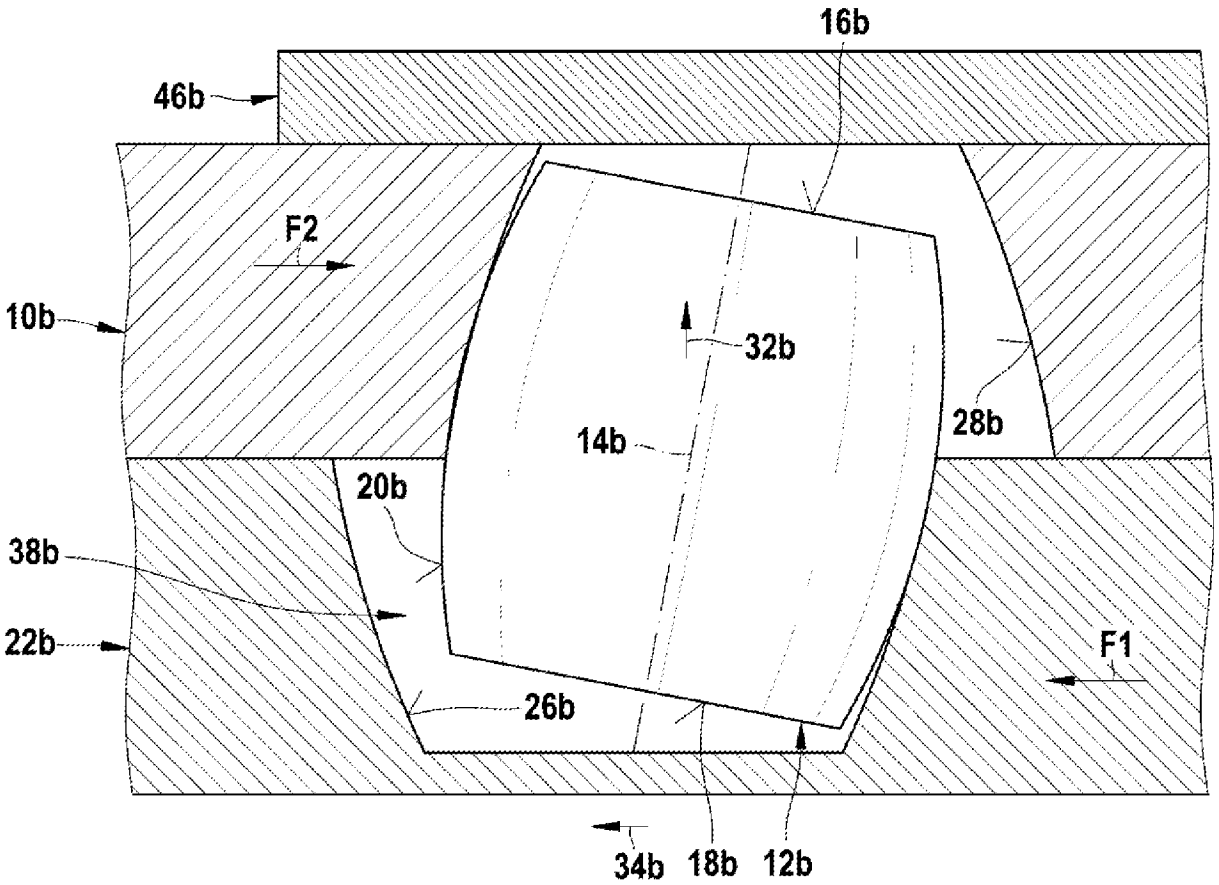
FIG. 3 shows an enlarged illustration of a detail of a first alternative, with play and tilt angle shown greatly exaggerated.
Figure 4:
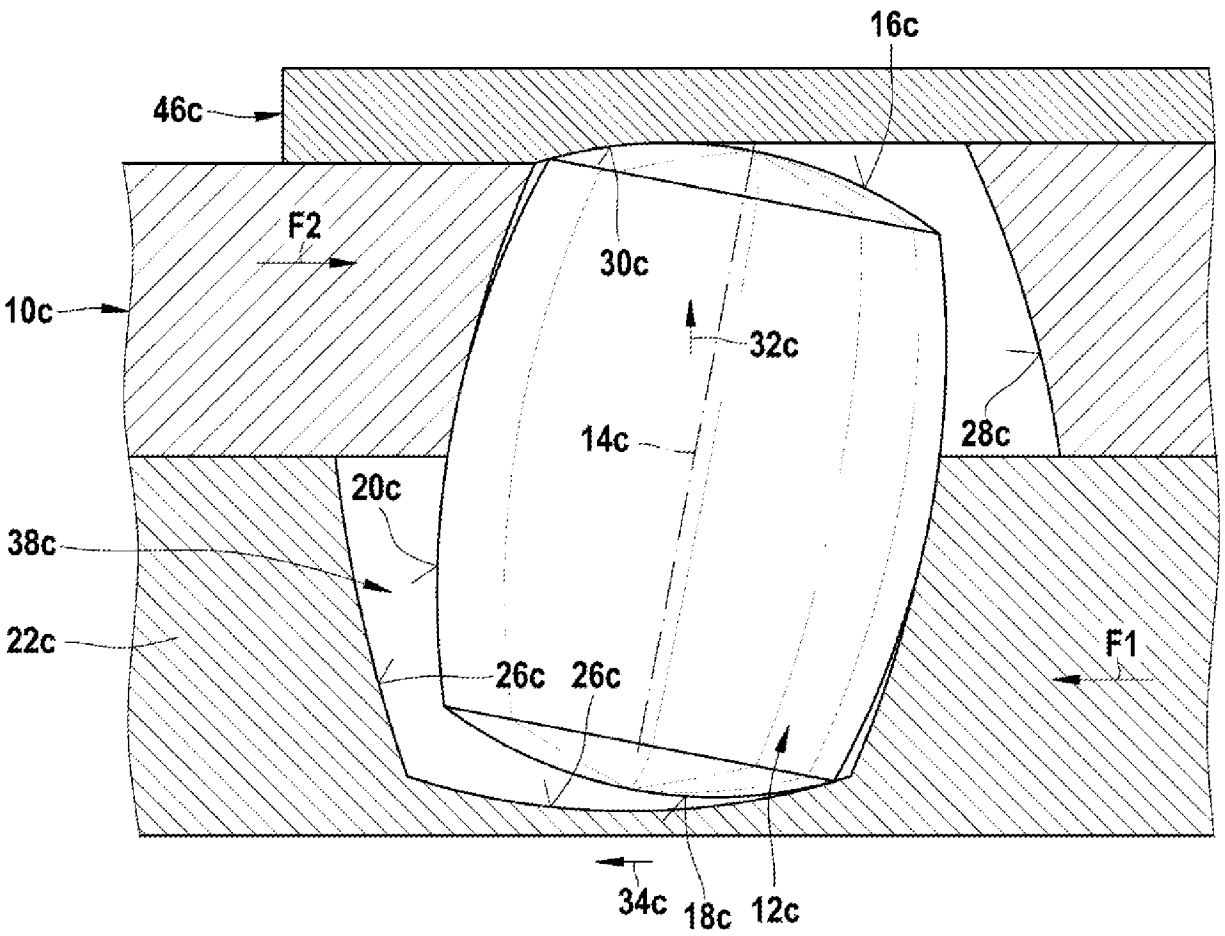
FIG. 4 shows an enlarged illustration of a detail of a second alternative, with play and tilt angle shown greatly exaggerated.

FIGS. 3 and 4 show details of alternative exemplary embodiments. Components, features and functions that remain the same are basically marked with the same reference numerals. To distinguish between the exemplary embodiments, the letters a to c are added to the reference numerals. The description below is basically restricted to the differences from the exemplary embodiment in FIGS. 1 and 2. With regard to features and functions that remain the same, reference may be made to the description of the exemplary embodiment in FIGS. 1 and 2.

FIG. 3 shows a detail of an alternative rotary- and chisel-hammer holding device having barrel-shaped locking bodies 12*b* which connect together a hammer tube 10*b* and a tool holder 22*b* of the rotary- and chisel-hammer holding device for conjoint rotation and in an axially fixed manner. The locking body 12*b* has a curved locking surface 20*b*, specifically a convexly curved lateral surface, and flat end faces 16*b*, 18*b*. For each locking body 12*b*, the hammer tube 10*b* has a radial through-aperture which is defined by a holding surface 28*b* of the hammer tube 10*b*, said holding surface 28*b* being concavely curved about a load tilting axis 14*b* and corresponding with the locking surface 20*b* in an operating state. The holding surface 28*b* of the hammer tube 10*b* is a lateral surface or encloses the locking body 12*b* by 360°. Furthermore, the tool holder 22*b* has a radial blind-hole recess which is defined by a holding surface 26*b* concavely curved about the load tilting axis 14*b* and corresponding with the locking surface 20*b* during operation. The holding surface 26*b* is formed by a lateral surface or encloses the locking body 12*b* by 360°. Compared with the exemplary embodiment in FIGS. 1 and 2, the hammer tube 10*b* is radially defined in the region of the locking body 12*b* directly by a portable power tool housing 46*b*. The hammer tube 10*b* is directly mounted in the portable power tool housing 46*b*.

FIG. 4 shows a detail of an alternative rotary- and chisel-hammer holding device having barrel-shaped locking bodies 12*c* which connect together a hammer tube 10*c* and a tool holder 22*c* of the rotary- and chisel-hammer holding device for conjoint rotation and in an axially fixed manner. The locking body 12*c* has three curved locking surfaces 16*c*, 18*c*, 20*c*, specifically a convexly curved lateral surface and two convexly curved end faces. For each locking body 12*c*, the hammer tube 10*c* has a radial through-aperture which is defined by a holding surface 28*c* of the hammer tube 10*c*, said holding surface 28*c* being concavely curved about a load tilting axis 14*c* and corresponding with the locking surface 20*c* in an operating state. Furthermore, the tool holder 22*c* has a radial blind-hole recess which is defined by a holding surface 26*c* concavely curved about the load tilting axis 14*c* and corresponding with the locking surface 20*c* during operation. The holding surface 26*c* is formed by a lateral surface or encloses the locking body 12*c* by 360°. The hammer tube 10*c* is radially defined in the region of the locking body 12*c* directly by a portable power tool housing 46*c*. The curved end faces of the locking body 12*c* correspond with a concave holding surface 30*c* of the portable power tool housing 46*c* pointing radially inward and with a concave holding surface 24*c* of the tool holder 22*c* pointing radially outward.

The invention claimed is:

1. A hammer holding device for a portable power tool, that has a striker operable to engage a workpiece, the hammer holding device, comprising:

a hammer tube;

at least one holding component; and at least one locking body which connects the hammer tube to the at least one holding component in a fitted state, wherein the at least on locking body has at least one locking surface curved about at least on load tilting axis; and wherein the at least one locking body is configured to tilt about the at least one load tilting axis in response to a main load of the portable power tool, the main load being a load acting on at least one of the at least one holding component and the hammer tube resulting from operation of the striker of the power tool to engage a workpiece, such that for each main load during operation of the portable power tool, in the fitted state, surface pressure between the at least one locking body and the at least one holding component is distributed over the at least one locking surface.

2. The holding device for a portable power tool as claimed in claim 1, wherein the at least one locking surface is formed at least partly by a cambered surface.

3. The holding device for a portable power tool as claimed in claim 1, wherein the at least one holding component diefines a tool holder having at least one holding surface which corresponds with the locking body in at least one operating state.

4. The holding device for a portable power tool as claimed in claim 3, wherein the tool holder is configured to receive a hammer that is at least one of (i) a rotary hammer, and (ii) a chisel hammer.

5. The holding device for a portable power tool as claimed in claim 1, wherein the hammer tube has at least one curved holding surface which corresponds with the at least one locking surface in at least one operating state.

6. The holding device for a portable power tool as claimed in claim 1, wherein the at least one holding component includes a curved holding surface which corresponds with the at least one locking surface in at least one operating state.

7. The holding device for a portable power tool as claimed in claim 1, wherein the locking body has, in the fitted state, a greater extent in a radial direction of the hammer tube than in an axial direction of the hammer tube.

8. The holding device for a portable power tool as claimed in claim 1, wherein the locking body has at least one curved end face.

9. The holding device for a portable power tool as claimed in claim 1, wherein the locking body has at least one curved lateral surface.

10. The holding device for a portable power tool as claimed in claim 1, wherein the locking body has at least two curved locking surfaces.

11. The holding device for a portable power tool as claimed in claim 1, wherein the at least one locking body is configured to tilt in a direction parallel to an axial direction of the hammer tube.

12. The holding device for a portable power tool as claimed in claim 1, wherein the at least one locking body is configured to tilt in a direction parallel to a circumferential direction of the hammer tube.

13. A portable power tool comprising:

a tool-holding device including:

a hammer tube at least one holding component configured to receive a tool; and at least one locking body which connects the hammer tube to the at least one further holding component in a fitted state, wherein the locking body has at least one locking surface curved about at least one load tilting axis: and wherein the at least one locking body is configured to tilt about the at least one load tilting axis in response to a main load of the portable power tool, the main load being a load acting on at least one of the at least one holding component and the hammer tube resulting from operation of the striker of the power tool to engage a workpiece, such that for each main load during operation of the portable power tool, in the fitted state, surface pressure between the at least one locking body and the at least one holding component is distributed over the at least one locking surface.

14. The portable power tool of claim 13, wherein the tool is at least one of (i) a rotary hammer, and (ii) a chisel hammer.

* * * * *